US011114237B2

(12) United States Patent
Peng et al.

(10) Patent No.: US 11,114,237 B2
(45) **Date of Patent: *Sep. 7, 2021**

(54) METHOD OF IMPROVING THE COERCIVITY OF ND—FE—B MAGNETS

(71) Applicant: Yantai Shougang Magnetic Materials, Inc., Yantai (CN)

(72) Inventors: Zhongjie Peng, Yantai (CN); Kunkun Yang, Yantai (CN); Mingfeng Xu, Yantai (CN); Guangyang Liu, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 410 days.

This patent is subject to a terminal disclaimer.

(21) Appl. No.: 16/042,408

(22) Filed: Jul. 23, 2018

(65) Prior Publication Data

US 2019/0027306 A1 Jan. 24, 2019

(30) Foreign Application Priority Data

Jul. 21, 2017 (CN) ..... 201710598036.8

(51) Int. Cl.

| | |
|---|---|
| ***H01F 41/02*** | (2006.01) |
| ***H01F 1/057*** | (2006.01) |
| ***C22C 38/00*** | (2006.01) |

(52) U.S. Cl.

CPC ..... *H01F 41/0293* (2013.01); *C22C 38/002* (2013.01); *C22C 38/005* (2013.01); *H01F 1/0577* (2013.01); *H01F 41/026* (2013.01); *C22C 2202/02* (2013.01)

(58) Field of Classification Search

CPC . C22C 2202/02; C22C 38/002; C22C 38/005; H01F 1/0577; H01F 41/026; H01F 41/0293

USPC ..... 148/302

See application file for complete search history.

(56) References Cited

U.S. PATENT DOCUMENTS

2013/0266472 A1* 10/2013 Wang ..... H01F 41/0293 419/35

2013/0271248 A1* 10/2013 Nagata ..... B22F 3/26 335/302

2020/0005996 A1* 1/2020 Yang ..... H01F 7/0215

* cited by examiner

*Primary Examiner* — Jie Yang

(74) *Attorney, Agent, or Firm* — William H. Honaker; Dickinson Wright PLLC

(57) ABSTRACT

A method of improving coercivity of an Nd—Fe—B magnet includes a first step of providing an Nd—Fe—B magnet having a first surface and a second surface. Next, a first solidified film of at least one pure heavy rare earth element is formed and attached to the first surface of the Nd—Fe—B magnet to prevent a reduction in corrosion resistance caused by oxygen and fluorine and hydrogen. After forming the first solidified film, the Nd—Fe—B magnet is subjected a diffusion treatment in a vacuum or an inert atmosphere. After the diffusion treatment, the Nd—Fe—B magnet is subjected to an aging treatment in the vacuum or the inert atmosphere.

12 Claims, No Drawings

METHOD OF IMPROVING THE COERCIVITY OF ND—FE—B MAGNETS

CROSS REFERENCE TO RELATED APPLICATION

This application claims priority to Chinese application serial number CN201710598036.8 filed on Jul. 21, 2017, the entire disclosure of which is incorporated herein by reference in its entirety.

BACKGROUND OF THE INVENTION

1. Field of the Invention

The present invention generally relates to a method of making Nd—Fe—B Magnets. In particular, the present invention relates to a method of improving coercivity of the Nd—Fe—B magnets.

2. Description of the Prior Art

Since its appearance in 1983, Nd—Fe—B magnets have been widely used in the applications of computers, automobiles, medical and wind power generators. Other high-end applications, in one aspect, require the Nd—Fe—B magnets to be more compact, lightweight, and thin and, in another aspect, require the Nd—Fe—B magnets to have having higher coercivity and remanence.

The coercivity of the Nd—Fe—B magnets can be improved by introducing pure metal of Dysprosium (Dy) or Terbium (Tb) or an alloy of Tb and Dy into the sintered Nd—Fe—B magnets. However, this process is undesirable because the process introduces Dy or Tb into the main phase thereby causing a reduction in the remanence of the Nd—Fe—B magnets. In addition, the process consumes a large amount of rare earth elements.

Introducing Dy or Tb or an alloy of Tb and Dy through an edge of the $Nd_2Fe_{14}B$ main phase hardens the $Nd_2Fe_{14}B$ main phase which can effectively increase the coercivity of the Nd—Fe—B magnets. Accordingly, many methods have been developed to place Nd—Fe—B magnets in an environment containing heavy rare earth metals such as Dy and Tb and subjected the Nd—Fe—B magnets to high temperature diffusion and aging treatments. This allows Dy and Tb to diffuse along the grain boundary phase and into the the $Nd_{12}Fe_{14}B$ main phase to increase the magnetic anisotropy of the $Nd_{12}Fe_{14}B$ main phase and the coercivity of the Nd—Fe—B magnets.

One such a method is disclosed in Japanese Patent Application JP2005-084213. The method includes a step of disposing a powder of oxides, flurides, or oxiflurides of Dy and Tb on the surface of the Nd—Fe—B magnets, and subject the Nd—Fe—B magnets to drying, diffusion, and aging treatments to increase the coercivity of the Nd—Fe—B magnets. However, after the drying treatment, the oxides, flurides, or oxiflurides of Dy and Tb can easily fall off the Nd—Fe—B magnets. In addition, during the diffusion treatment, along with Dy and Tb elements of fluorine and oxygen can also be diffused into the Nd—Fe—B magnets which adversely affect the mechanical properties and the corrosion resistance of the Nd—Fe—B magnets.

Another method is disclosed in Chinese Patent Application CN101375352A. The method includes a step of depositing an M layer wherein M is a metallic element selected from the group consisting of Al, Ga, In, Sn, Pb, Bi, Zn and Ag on a surface of an Nd—Fe—B magnet using vacuum evaporation, ion plating, or sputtering process. Then, a heavy rare-earth element layer is disposed on the M layer wherein the M layer promotes the diffusion of the heavy rare-earth element layer into the Nd—Fe—B magnets to increase the magnetic properties of the Nd—Fe—B magnet. However, the high temperatures used during the vapor deposition will affect the Nd—Fe—B magnets. In addition, there is a high cost associated with the using the sputtering process because there is a low utilization of heavy metals as a target source for the sputtering process.

SUMMARY OF THE INVENTION

The present invention overcomes the above deficiencies, provides a method of improving the coercivity of NdFeB magnets, and improves the cost-efficiency of making the Nd—Fe—B magnets. The present invention also provides a method of improving the coercivity of Nd—Fe—B magnets without reducing the remanence of the Nd—Fe—B magnets. In addition, the present invention has a high utilization rate of the heavy rare earth metals and allows for a fast speed of formation for the pure heavy rare earth metals film and, therefore, is very convenient for mass production. Furthermore, the present invention provides a high efficiency and a low cost method of increasing the coercivity of the Nd—Fe—B magnets in comparison with using powders of oxides, flurides, or oxiflurides of Dy and Tb and avoids reductions in mechanical properties and corrosion resistance of the Nd—Fe—B magnets caused by oxygen, fluoride, and hydrogen.

The present invention provides a method of improving coercivity of an Nd—Fe—B magnet. The method includes a first step of providing an Nd—Fe—B magnet having a first surface and a second surface. Next, a first solidified film of at least one pure heavy rare earth element is formed and attached to the first surface of the Nd—Fe—B magnet to prevent a reduction in corrosion resistance caused by oxygen and fluorine and hydrogen. Then, the Nd—Fe—B magnet including the first solidified film is subjected a diffusion treatment in a vacuum or an inert atmosphere. Following the Nd—Fe—B magnet including the first solidified film is subjected to an aging treatment in the vacuum or the inert atmosphere.

DESCRIPTION OF THE ENABLING EMBODIMENT

The present invention provides a method of improving coercivity of an Nd—Fe—B magnet. The method includes a first step of providing an Nd—Fe—B magnet. The Nd—Fe—B magnet includes a first surface and a second surface. The first surface and the second surface are disposed opposite and spaced from one another thereby defining a thickness of between 0.5 mm and 10 mm.

The Nd—Fe—B magnets can be manufactured from a process using an R-T-B material wherein R is at least one element selected from rare earth elements including Sc and Y, T is at least one element selected from Fe and Co, and B is Boron. During the process, the R-T-B material is first melted into an R-T-B alloy using an ingot casting or a strip casting process. Next, the R-T-B alloy is subjected to a hydrogen decrepitation process and a milling process to produce a plurality of fine R-T-B powders. Then, the fine R-T-B powders are molded and magnetized during an isostatic pressing process to produce a compact. The compact is sintered and machined into the Nd—Fe—B magnets.

The next step of the method is forming a first solidified film of at least one pure heavy rare earth element on the first surface of the Nd—Fe—B magnet. The step of forming the first solidified film is defined as depositing a first layer of powders of at least one pure heavy rare earth element selected from a group consisting of Dy, Tb, or an alloy of Dy and Tb on the first surface of the Nd—Fe—B magnet under an inert atmosphere of Argon. The powders has a particle size of between 0.5 μm and 300 μm wherein the weight proportion of the powders of at least one pure heavy rare earth element on the first surface to the Nd—Fe—B is between 0.1% and 2%. The step of forming the first solidified film includes a step of heating the first surface of the Nd—Fe—B magnet including the first layer using lighting or laser cladding to form the first solidified film of the powders attached to the first surface of the Nd—Fe—B magnet. Lighting, e.g. halogen lighting, or laser cladding provides a rapid heating of the first surface of the Nd—Fe—B magnet including the first layer of powders of at least one pure heavy rare earth element. As a result of the rapid heating, the first layer of powders of at least one pure heavy rare earth element becomes attached to the first surface of the Nd—Fe—B magnet forming the first solidified film on the first surface of the Nd—Fe—B magnet. The rapid heating is a simple method of operation and allows for a fast speed of formation for the first solidified film and, therefore, is very convenient for mass production. After heating the first surface of the Nd—Fe—B magnet, the Nd—Fe—B magnet including the first solidified film is cooled.

After forming the first solidified film, the method includes a step of forming a second solidified film of at least one pure heavy rare earth element attached to the second surface of the Nd—Fe—B magnet. The step of forming the second solidified film is defined as depositing a second layer of at least one pure heavy rare earth element selected from a group consisting of Dy, Tb, or an alloy of Dy and Tb under an inert atmosphere of Argon. The powders has a particle size of between 0.5 μm and 300 μm wherein the weight proportion of the powders of at least one pure heavy rare earth element on the second surface to the Nd—Fe—B is between 0.1% and 2%. The step of forming the second solidified film includes a step of heating the second surface of the Nd—Fe—B magnet including the second layer using lighting or laser cladding to form the second solidified film of the powders attached to the second surface of the Nd—Fe—B magnet. Lighting, e.g. halogen lighting, or laser cladding provides a rapid heating of the second surface of the Nd—Fe—B magnet including the second layer of powders of at least one pure heavy rare earth element. As a result of the rapid heating, the second layer of powders of at least one pure heavy rare earth element becomes attached to the second surface of the Nd—Fe—B magnet forming a second solidified film on the second surface of the Nd—Fe—B magnet. The rapid heating is a simple method of operation and allows for a fast speed of formation for the second solidified film and, therefore, is very convenient for mass production.

After forming the first solidified film and the second solidified film, the Nd—Fe—B magnet including the first solidified film and the second solidified film is subjected to a diffusion treatment and an aging treatment in a vacuum or an inert atmosphere of Argon. The diffusion treatment is conducted at a diffusion temperature of between 800° C. and 1000° C. for a diffusion duration of between 3 hours and 72 hours. After the diffusion treatment, the Nd—Fe—B magnet is cooled and subjected to the aging treatment. During the aging treatment, the Nd—Fe—B magnet is heated wherein the aging treatment is conducted at an aging temperature of between 450° C. and 700° C. for an aging duration of between 3 hours and 15 hours. It should be appreciated that the diffusion treatment and aging treatment can be conducted after only forming the first solidified film.

Using diffusion and aging treatments in connection with the Nd—Fe—B magnet having the first solidified film increases the coercive force of the Nd—Fe—B magnet without a reduction in the remanence of the Nd—Fe—B magnet. Without being bound by theory, it is believed that the diffusion treatment introduces Dy or Tb or an alloy of Dy and Tb contained in the first solidified film and the second solidified film through an edge of a main phase of the Nd—Fe—B magnet to the main phase of the Nd—Fe—B magnet thereby hardens the main phase to increase the coercivity of the Nd—Fe—B magnets. In other words, the diffusion and aging treatments allow for a wide distribution of the at least one pure heavy rare earth element from the first solidified film and the second solidified film into the Nd—Fe—B magnet thereby enhancing the coercivity without reducing the remanence of the Nd—Fe—B magnets. In addition, because the first solidified film and the second solidified film are formed from at least one pure heavy rare earth element, the diffusion and aging treatments have a high utilization rate of the heavy rare earth elements.

Implementing examples are provided below to provide a better illustration of the present invention. The implementing examples are used for illustrative purposes only and do not limit the scope of the present invention.

Implementing Example 1

A plurality of Nd—Fe—B magnets, each having a dimension of 20 mm×20 mm×2 mm, is provided in a compartment protected under an inert atmosphere of Argon (Ar). The Nd—Fe—B magnets include a first surface and a second surface. A first layer of powders of Dysprosium (Dy), having an average particle size of 2 μm, is evenly deposited on a first surface of the Nd—Fe—B magnets. The weight of the powders of Dy is 0.3% of the weight of the Nd—Fe—B magnets. Then, the first surface of the Nd—Fe—B magnets including the first layer of powders of Dy is rapidly heated via lighting, e.g. using tungsten halogen lamp, to form the first solidified film of the powders attached to the first surface of the Nd—Fe—B magnets. Next, the Nd—Fe—B magnets including the first solidified film are cooled.

After cooling the Nd—Fe—B magnets, the Nd—Fe—B magnets are flipped over and a second layer of powders of Dy is evenly deposited on a second surface of the Nd—Fe—B magnets. The weight of the powders of Dy is 0.3% of the weight of the Nd—Fe—B magnets. Then, the second surface of the Nd—Fe—B magnets including the second layer of powders of Dy is rapidly heated via lighting, e.g. using tungsten halogen lamp, to form the second solidified film of the powders attached to the second surface of the Nd—Fe—B magnets.

Next, the Nd—Fe—B magnets including the first solidified film and the second solidified film are placed in a vacuum furnace to subject the Nd—Fe—B magnets to a diffusion treatment and an aging treatment under vacuum or an inert atmosphere of Ar. The diffusion treatment is conducted at a diffusion temperature of between 900° C. for a diffusion duration of 10 hours. The Nd—Fe—B magnets are then cooled and reheated to subjected the Nd—Fe—B magnets to the aging treatment at an aging temperature of between 500° C. for an aging duration of 6 hours.

The magnetic properties of the Nd—Fe—B magnets of Implementing Example 1 and the magnetic properties of an untreated Nd—Fe—B magnet is illustrated below in Table 1.

TABLE 1

| | Br(KGS) | Hcj(KOe) | HK/Hcj |
|---|---|---|---|
| Untreated Nd—Fe—B Magnets | 14.15 | 17.99 | 0.97 |
| Implementing Example 1 | 14.05 | 23.01 | 0.96 |

As illustrated in Table 1, the Nd—Fe—B magnets covered with a 0.6% of Dy (the Nd—Fe—B magnets of implementing example 1) has a higher coercivity without a significant reduction in the remanence (Br) and the squareness (HK/Hcj). In particular, the Nd—Fe—B magnets of implementing example 1 has a 5.02 KOe increase in coercivity and 0.1 KGS reduction in remanence with minimal changes to the squareness.

Implementing Example 2

A plurality of Nd—Fe—B magnets, each having a dimension of 20 mm×20 mm×2 mm, is provided in a compartment protected under an inert atmosphere of Argon. The Nd—Fe—B magnets include a first surface and a second surface. A first layer of powders of Terbium (Tb), having an average particle size of 300 μm, is evenly deposited on a first surface of the Nd—Fe—B magnets. The weight of the powders of Tb is 0.3% of the weight of the Nd—Fe—B magnets. Then, the first surface of the Nd—Fe—B magnets including the first layer of powders of Tb is rapidly heated via lighting, e.g. using tungsten halogen lamp, to form the first solidified film of the powders attached to the first surface of the Nd—Fe—B magnets. Next, the Nd—Fe—B magnets including the first solidified film are cooled.

After cooling the Nd—Fe—B magnets, the Nd—Fe—B magnets are flipped over and a second layer of powders of Tb is evenly deposited on a second surface of the Nd—Fe—B magnets. The weight of the powders of Tb is 0.3% of the weight of the Nd—Fe—B magnets. Then, the second surface of the Nd—Fe—B magnets including the second layer of powders of Tb is rapidly heated via lighting, e.g. using tungsten halogen lamp, to form the second solidified film of the powders attached to the second surface of the Nd—Fe—B magnets.

Next, the Nd—Fe—B magnets including the first solidified film and the second solidified film are placed in a vacuum furnace to subject the Nd—Fe—B magnets to a diffusion treatment and an aging treatment under vacuum or an inert atmosphere of Argon. The diffusion treatment is conducted at a diffusion temperature of between 800° C. for a diffusion duration of 30 hours. The Nd—Fe—B magnets are then cooled and reheated to subjected the Nd—Fe—B magnets to the aging treatment at an aging temperature of between 470° C. for an aging duration of 6 hours.

The magnetic properties of the Nd—Fe—B magnets of Implementing Example 2 and the magnetic properties of an untreated Nd—Fe—B magnet is illustrated below in Table 2.

TABLE 2

| | Br(KGs) | Hcj(KOe) | HK/Hcj |
|---|---|---|---|
| Untreated Nd—Fe—B Magnets | 14.15 | 17.99 | 0.97 |
| Implementing Example 2 | 14.10 | 25.6 | 0.96 |

As illustrated in Table 2, the Nd—Fe—B magnets covered with a 0.6% of Tb (the Nd—Fe—B magnets of implementing example 2) has a higher coercivity without a significant reduction in the remanence (Br) and the squareness (HK/Hcj). In particular, the Nd—Fe—B magnets of implementing example 2 has a 7.6 KOe increase in coercivity and 0.05 KGS reduction in remanence with minimal changes to the squareness.

Implementing Example 3

A plurality of Nd—Fe—B magnets, each having a dimension of 20 mm×20 mm×10 mm, is provided in a compartment protected under an inert atmosphere of Argon (Ar). The Nd—Fe—B magnets include a first surface and a second surface. A first layer of powders of Dysprosium (Dy), having an average particle size of 200 μm, is evenly deposited on a first surface of the Nd—Fe—B magnets. The weight of the powders of Dy is 1.0% of the weight of the Nd—Fe—B magnets. Then, the first surface of the Nd—Fe—B magnets including the first layer of powders of Dy is rapidly heated via laser cladding to form the first solidified film of the powders attached to the first surface of the Nd—Fe—B magnets. Next, the Nd—Fe—B magnets including the first solidified film are cooled.

After cooling the Nd—Fe—B magnets, the Nd—Fe—B magnets are flipped over and a second layer of powders of Dy is evenly deposited on a second surface of the Nd—Fe—B magnets. The weight of the powders of Dy is 1.0% of the weight of the Nd—Fe—B magnets. Then, the second surface of the Nd—Fe—B magnets including the second layer of powders of Dy is rapidly heated via laser cladding to form the second solidified film of the powders attached to the second surface of the Nd—Fe—B magnets.

Next, the Nd—Fe—B magnets including the first solidified film and the second solidified film are placed in a vacuum furnace to subject the Nd—Fe—B magnets to a diffusion treatment and an aging treatment under vacuum or an inert atmosphere of Ar. The diffusion treatment is conducted at a diffusion temperature of between 850° C. for a diffusion duration of 72 hours. The Nd—Fe—B magnets are then cooled and reheated to subjected the Nd—Fe—B magnets to the aging treatment at an aging temperature of between 560° C. for an aging duration of 15 hours.

The magnetic properties of the Nd—Fe—B magnets of Implementing Example 3 and the magnetic properties of an untreated Nd—Fe—B magnet is illustrated below in Table 3.

TABLE 3

| | Br(KGs) | Hcj(KOe) | HK/Hcj |
|---|---|---|---|
| Untreated Nd—Fe—B Magnets | 13.93 | 18.9 | 0.97 |
| Implementing Example 3 | 13.7 | 26.1 | 0.95 |

As illustrated in Table 3, the Nd—Fe—B magnets covered with a 2.0% of Dy (the Nd—Fe—B magnets of implementing example 3) has a higher coercivity without a significant reduction in the remanence (Br) and the squareness (HK/Hcj). In particular, the Nd—Fe—B magnets of implementing example 3 has a 7.2 KOe increase in coercivity and 0.23 KGS reduction in remanence with minimal changes to the squareness.

Implementing Example 4

A plurality of Nd—Fe—B magnets, each having a dimension of 20 mm×20 mm×10 mm, is provided in a compartment protected under an inert atmosphere of Argon (Ar). The Nd—Fe—B magnets include a first surface and a second surface. A first layer of powders of Terbium (Tb), having an average particle size of 2 μm, is evenly deposited on a first surface of the Nd—Fe—B magnets. The weight of the powders of Tb is 0.8% of the weight of the Nd—Fe—B magnets. Then, the first surface of the Nd—Fe—B magnets including the first layer of powders of Tb is rapidly heated via laser cladding to form the first solidified film of the powders attached to the first surface of the Nd—Fe—B magnets. Next, the Nd—Fe—B magnets including the first solidified film are cooled.

After cooling the Nd—Fe—B magnets, the Nd—Fe—B magnets are flipped over and a second layer of powders of Tb is evenly deposited on a second surface of the Nd—Fe—B magnets. The weight of the powders of Tb is 0.8% of the weight of the Nd—Fe—B magnets. Then, the second surface of the Nd—Fe—B magnets including the second layer of powders of Tb is rapidly heated via laser cladding to form the second solidified film of the powders attached to the second surface of the Nd—Fe—B magnets.

Next, the Nd—Fe—B magnets including the first solidified film and the second solidified film are placed in a vacuum furnace to subject the Nd—Fe—B magnets to a diffusion treatment and an aging treatment under vacuum or an inert atmosphere of Ar. The diffusion treatment is conducted at a diffusion temperature of between 960° C. for a diffusion duration of 24 hours. The Nd—Fe—B magnets are then cooled and reheated to subjected the Nd—Fe—B magnets to the aging treatment at an aging temperature of between 560° C. for an aging duration of 15 hours.

The magnetic properties of the Nd—Fe—B magnets of Implementing Example 4 and the magnetic properties of an untreated Nd—Fe—B magnet is illustrated below in Table 4.

TABLE 4

| | Br(KGs) | Hcj(KOe) | HK/Hcj |
|---|---|---|---|
| Untreated Nd—Fe—B Magnets | 13.93 | 18.9 | 0.97 |
| Implementing Example 4 | 13.83 | 29.5 | 0.96 |

As illustrated in Table 4, the Nd—Fe—B magnets covered with a 1.6% of Dy (the Nd—Fe—B magnets of implementing example 4) has a higher coercivity without a significant reduction in the remanence (Br) and the squareness (HK/Hcj). In particular, the Nd—Fe—B magnets of implementing example 4 has a 10.6 KOe increase in coercivity and 0.1 KGS reduction in remanence with minimal changes to the squareness.

As illustrated in Implementing Examples 1-4 above, rapidly heating the first and second layers of powders of the least one pure heavy rare earth metal to form the first and second solidified film on the Nd—Fe—B magnets and subjecting the Nd—Fe—B magnets to diffusion and aging treatments results in an significant improvement in the coercivity of the Nd—Fe—B magnets. The Nd—Fe—B magnets of the present invention also contains minimal amount of Carbon (C), Hydrogen (H), Oxygen (O), Nitrogen (N), and Fluorine (F). In particular, C is less than 800 ppm, H is less than 20 ppm, 0 is less than 800 ppm, N is less than 200 ppm, and F is less than 20 ppm.

Implementing Example 5

A plurality of Nd—Fe—B magnets, each having a dimension of 20 mm×20 mm×0.5 mm, is provided in a compartment protected under an inert atmosphere of Argon (Ar). The Nd—Fe—B magnets include a first surface and a second surface. A first layer of powders of Dysprosium (Dy), Terbium (Tb), and an alloy of Dy and Tb having an average particle size of 0.5 μm, is evenly deposited on a first surface of the Nd—Fe—B magnets. The weight of the powders of Dy, Tb, and the alloy of Dy and Tb is 0.1% of the weight of the Nd—Fe—B magnets. Then, the first surface of the Nd—Fe—B magnets including the first layer of powders of Dy, Tb, and the alloy of Dy and Tb is rapidly heated via lighting, e.g. using a Tungsten Halogen Lamp, to form a first solidified film attached to the first surface of the Nd—Fe—B magnets.

Next, the Nd—Fe—B magnets including the first solidified film are placed in a vacuum furnace to subject the Nd—Fe—B magnets to a diffusion treatment and an aging treatment under vacuum or an inert atmosphere of Ar. The diffusion treatment is conducted at a diffusion temperature of between 1000° C. for a diffusion duration of 3 hours. The Nd—Fe—B magnets are then cooled and reheated to subjected the Nd—Fe—B magnets to the aging treatment at an aging temperature of between 700° C. for an aging duration of 3 hours.

Implementing Example 6

A plurality of Nd—Fe—B magnets, each having a dimension of 20 mm×20 mm×5 mm, is provided in a compartment protected under an inert atmosphere of Argon (Ar). The Nd—Fe—B magnets include a first surface and a second surface. A first layer of powders of Dysprosium (Dy) and Terbium (Tb), having an average particle size of 100 μm, is evenly deposited on a first surface of the Nd—Fe—B magnets. The weight of the powders of Dy and Tb is 0.2% of the weight of the Nd—Fe—B magnets. Then, the first surface of the Nd—Fe—B magnets including the first layer of powders of Dy and Tb is rapidly heated via lighting, e.g. using a Tungsten Halogen Lamp, to form a first solidified film attached to the first surface of the Nd—Fe—B magnets.

After cooling the Nd—Fe—B magnets, the Nd—Fe—B magnets are flipped over and a second layer of powders of Dy and Tb is evenly deposited on a second surface of the Nd—Fe—B magnets. The weight of the powders of Dy and Tb is 0.2% of the weight of the Nd—Fe—B magnets. Then, the second surface of the Nd—Fe—B magnets including the second layer of powders of Dy and Tb is rapidly heated via lighting, e.g. using a Tungsten Halogen Lamp, to form the second solidified film attached to the second surface of the Nd—Fe—B magnets.

Next, the Nd—Fe—B magnets including the first solidified film and the second solidified film are placed in a vacuum furnace to subject the Nd—Fe—B magnets to a diffusion treatment and an aging treatment under vacuum or an inert atmosphere of Ar. The diffusion treatment is conducted at a diffusion temperature of 850° C. for a diffusion duration of 60 hours. The Nd—Fe—B magnets are then cooled and reheated to subjected the Nd—Fe—B magnets to the aging treatment at an aging temperature of between 450° C. for an aging duration of 15 hours.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of improving coercivity of an Nd—Fe—B magnet, said method comprising the steps of:

providing an Nd—Fe—B magnet having a first surface and a second surface;

forming a first solidified film of at least one pure heavy rare earth element attached to the first surface of the Nd—Fe—B magnet to prevent a reduction in corrosion resistance caused by oxygen and fluorine and hydrogen;

wherein said step of forming the first solidified film comprises depositing a first layer of at least one pure heavy rare earth element powder selected from the group consisting of Dy, Tb, an alloy of Dy and Tb, and mixtures thereof onto the first surface of the Nd—Fe—B magnet under an inert atmosphere, then heating the first surface of the Nd—Fe—B magnet including the first layer to form the first solidified film of the powders attached to the first surface of the Nd—Fe—B magnet;

then forming a second solidified film of at least one pure heavy rare earth element on the second surface of the Nd—Fe—B magnet;

wherein said step of forming the second solidified film comprises depositing a second layer of at least one pure heavy rare earth element powder selected from the group consisting of Dy, Tb, an alloy of Dy and Tb, and mixtures thereof onto the second surface of the Nd—Fe—B magnet under an inert atmosphere and then heating the second surface of the Nd—Fe—B magnet including the second layer to form the second solidified film of the powders on the second surface of the Nd—Fe—B magnet;

subjecting the Nd—Fe—B magnet including the first solidified film and the second solidified film to a diffusion treatment in a vacuum or an inert atmosphere; and subjecting the Nd—Fe—B magnet including the first solidified film and the second solidified film to an aging treatment in the vacuum or the inert atmosphere.

2. The method as set forth in claim 1 wherein said step of depositing the first layer is defined as depositing the first layer under the inert atmosphere of argon.

3. The method as set forth in claim 1 wherein said step of depositing the first layer is defined as depositing the first layer of at least one pure heavy rare earth element powder having a particle size of between 0.5 μm and 300 μm onto the first surface of the Nd—Fe—B magnet under an inert atmosphere whereby a weight proportion of the at least one pure heavy rare earth element powder on the first surface to the Nd—Fe—B magnet is between 0.1% and 2% by weight base on a total weight of the magnet.

4. The method as set forth in claim 1 wherein said step of heating the first surface is defined as heating the first surface of the Nd—Fe—B magnet including the first layer using lighting.

5. The method as set forth in claim 1 wherein said step of forming the first solidified film further includes a step of cooling the first solidified film on the first surface of the Nd—Fe—B magnet.

6. The method as set forth in claim 1 wherein said step of depositing the second layer is defined as depositing the second layer under the inert atmosphere of argon.

7. The method as set forth in claim 1 wherein said step of depositing the second layer is defined as depositing the second layer of at least one pure heavy rare earth element powder having a particle size of between 0.5 μm and 300 μm onto the second surface of the Nd—Fe—B magnet under an inert atmosphere whereby a weight proportion of the at least one pure heavy rare earth element powders on the second surface to the Nd—Fe—B magnet is between 0.1% and 2% by weight based on a total weight of the magnet.

8. The method as set forth in claim 1 wherein said step of heating the second surface is defined as heating the second surface of the Nd—Fe—B magnet including the second layer using lighting.

9. The method as set forth in claim 1, wherein said step of subjecting the Nd—Fe—B magnet including the first solid film to the diffusion treatment is defined as subjecting the Nd—Fe—B magnet including the first solidified film to the diffusion treatment in the vacuum or the inert atmosphere at a diffusion temperature of between 800° C. and 1000° C. for a diffusion duration of between 3 hours and 72 hours; and cooling the Nd—Fe—B magnet in the vacuum or the inert atmosphere.

10. The method as set forth in claim 1, wherein said step of subjecting the Nd—Fe—B magnet including the first solid film to the aging treatment is defined as subjecting the Nd—Fe—B magnet including the first solidified film to the aging treatment in the vacuum or the inert atmosphere at an aging temperature of between 450° C. and 700° C. for an aging duration of between 3 hours and 15 hours.

11. The method as set forth in claim 1, wherein said step of providing the Nd—Fe—B magnet is further defined as providing the Nd—Fe—B magnet having a first surface and a second surface opposite and spaced from one another defining a thickness of between 0.5 mm and 10 mm.

12. A method of improving coercivity of an Nd—Fe—B magnet, said method comprising the steps of:

providing an Nd—Fe—B magnet including a first surface and a second surface disposed opposite and spaced apart from one another defining a thickness of between 0.5 mm and 10 mm;

forming a first solidified film of at least one pure heavy rare earth element attached to the first surface of the Nd—Fe—B magnet to prevent a reduction in corrosion resistance caused by oxygen and fluorine and hydrogen;

said step of forming the first solidified film comprising depositing a first layer of powder selected from the group consisting of Dy, Tb, an alloy of Dy and Tb, and mixtures thereof, the powder having a particle size of between 0.5 μm and 300 μm on the first surface of the Nd—Fe—B magnet under an inert atmosphere of Ar with weight proportion of the powders on the first surface of the Nd—Fe—B magnet being between 0.1% and 2% by weight based on a total weight of the magnet;

said step of forming the first solidified film further including a step of heating the first surface of the Nd—Fe—B magnet including the first layer using lighting or laser cladding to form the first solidified film of the powder attached to the first surface of the Nd—Fe—B magnet;

said step of forming the first solidified film further including a step of cooling the first solidified film on the first surface of the Nd—Fe—B magnet;

then forming a second solidified film of at least one pure heavy rare earth element attached to the second surface of the Nd—Fe—B magnet to prevent a reduction in corrosion resistance caused by oxygen and fluorine and hydrogen;

said step of forming the second solidified film comprising depositing a second layer of powder selected from the group consisting of Dy, Tb, an alloy of Dy and Tb, and mixture thereof, the powder having a particle size of between 0.5 μm and 300 μm onto the second surface of the Nd—Fe—B magnet under an inert atmosphere of Ar with weight proportion of the powders on the second surface of the Nd—Fe—B magnet being between 0.1% and 2% by weight based on the total weight of the magnet;

said step of forming the second solidified film further including a step of heating the second surface of the Nd—Fe—B magnet including the second layer using lighting or laser cladding to form a second solidified film of the powders on the second surface of the Nd—Fe—B magnet; and subjecting the Nd—Fe—B magnet including the first solidified film and the second solidified film to a diffusion treatment in a vacuum or an inert atmosphere with the diffusion treatment being conducted at a diffusion temperature of between 800° C. and 1000° C. for a diffusion duration of between 3 hours and 72 hours;

cooling the Nd—Fe—B magnet in the vacuum or the inert atmosphere; and subjecting the Nd—Fe—B magnet including the first solidified film and the second solidified film to an aging treatment in the vacuum or in the inert atmosphere at an aging temperature of between 450° C. and 700° C. for an aging duration of between 3 hours and 15 hours.

* * * * *